United States Patent [19]

Meinecke et al.

[11] 4,011,642

[45] Mar. 15, 1977

[54] METHOD FOR MANUFACTURING A SEALED BEAMED HEADLIGHT

[75] Inventors: Klaus Meinecke, Brand; Dieter Wilhelm, Eschweiler; Leo Coir, Brand; Jürgen Tillack, Aachen; Helmut Samulowitz, Verlautenheide; Karl Gebhardt, Stolberg, all of Germany

[73] Assignee: U.S. Philips Corporation, New York, N.Y.

[22] Filed: July 17, 1975

[21] Appl. No.: 596,956

Related U.S. Application Data

[62] Division of Ser. No. 463,198, April 22, 1974, Pat. No. 3,904,904.

[30] Foreign Application Priority Data

Apr. 28, 1973 Germany ..... 2321709

[52] U.S. Cl. ..... 29/25.16; 29/25.18; 316/23

[51] Int. Cl.[2] ..... H01J 9/18; H01J 9/36

[58] Field of Search ..... 29/25.11, 25.13, 25.15, 29/25.16, 25.18, 25.2; 316/23, 29

[56] References Cited

UNITED STATES PATENTS 3,737,960 6/1973 Billson ..... 29/25.15

*Primary Examiner*—W. Tupman
*Attorney, Agent, or Firm*—Frank R. Trifari; Robert S. Smith

[57] ABSTRACT

A method for maintaining a sealed beam lamp unit comprising a quartz iodine lamp accommodated in an outer envelope. A sleeve-shaped cap which is made of a metal strip material surrounds the lamp pinch which is substantially rectangular in cross-section and to which a wire is secured which serves as the sole support for the lamp.

4 Claims, 4 Drawing Figures

METHOD FOR MANUFACTURING A SEALED BEAMED HEADLIGHT

Figure 1:
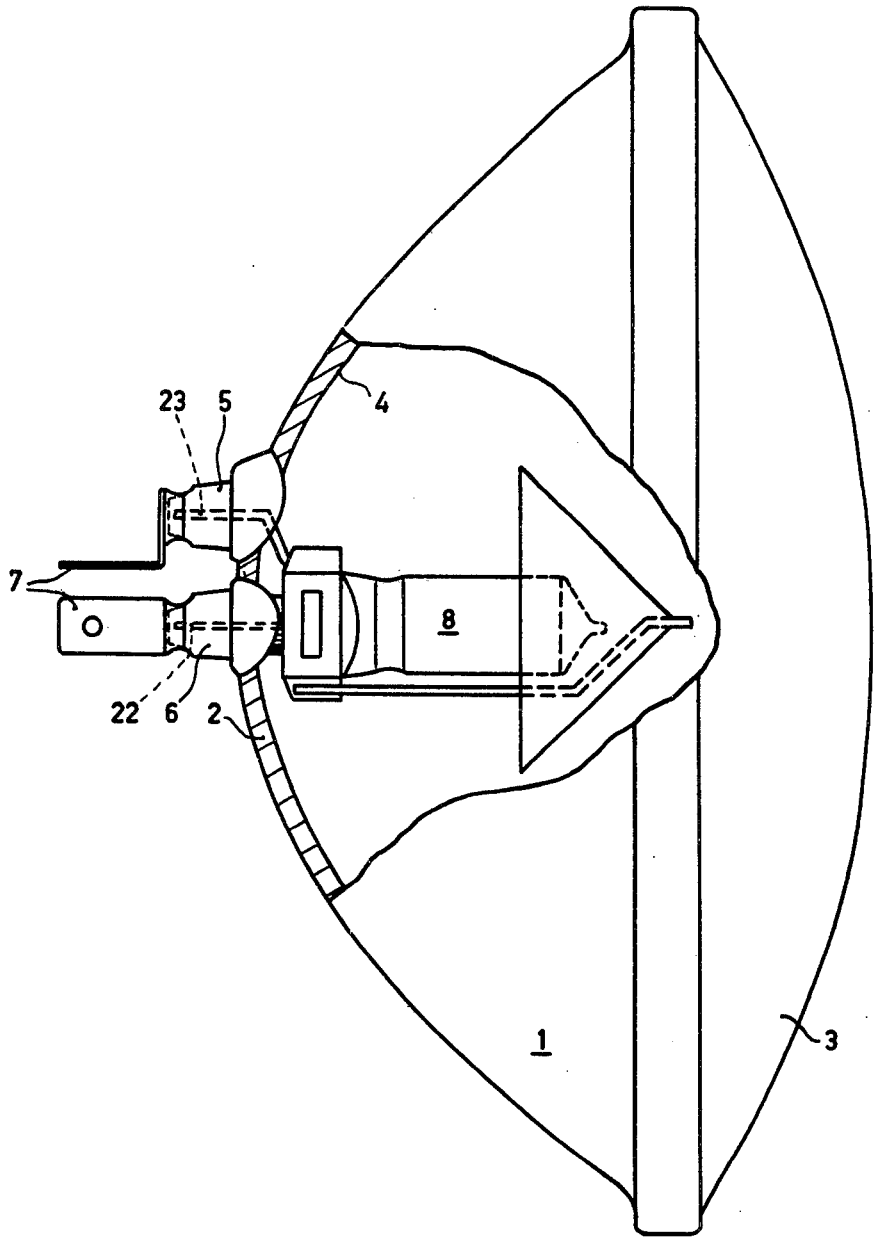

This application is a divisional of U.S. application Ser. No. 463,198 filed Apr. 22, 1974, now U.S. Pat. No. 3,904,904 dated Sept. 9, 1975.

The invention relates to an electric sealed beam lamp unit, in particular for use as a motor-vehicle head lamp, comprising an outer envelope which consists of a concave reflector portion and a transparent front glass lens and in which a filament lamp of high luminous intensity, for example a quartz halogen lamp is arranged which is provided with a pinch-shaped lamp cap mounted in a lamp holder which is held by a wire support secured in sleeve-shaped pinches of the reflector part.

Such lamps are also referred to as halogen sealed beam lamps. As is known, the halogen cycle operates only at comparatively high temperatures which in turn are achieved only in a correspondingly small bulb. Hence halogen sealed beam lamps cannot be used without additionally sealed inner bulbs.

In a known sealed beam lamp unit of the type specified (British patent specification No. 1,221,946) the pinch of the lamp is inserted between parallel arranged fingers of a ceramic bulb support member. The end of the support member remote from the fingers is formed with a transverse groove in which the bent portions of current supply leads lie. The other ends of the current supply leads are secured in sleeve-shaped pinches of the reflector part. In order to maintain the lamp in its correct position relative to the reflector part, the bulb is additionally embraced by a front light shield supported by a rod which is led out through the reflector part.

In another known sealed beam lamp unit of the specified type a filament lamp having no cap is inserted into a ceramic plate in which it first is adjusted into the correct position and then secured by means of a cement. The lamp unit is then aligned with respect to the parabolic reflector part in that three metal tubes anchored on the ceramic plate are slipped onto three supporting pins which are secured by brazing in the pinches in the reflector part. Subsequently the lamp is fixed by squeezing the metal tubes about the pins so that the latter are clamped in the tubes.

Mounting the filament lamp in a known sealed beam unit is a comparatively laborious and expensive operation. In addition, the ceramic bulb support member or the ceramic plate so increases the mass of the lamp that, in particular if the unit is used as a motor-vehicle head lamp, inadmissible vibration may be produced so that the filament lamp is likely to lose its correct position relative to the outer envelope.

It is an object of the present invention to provide an electric sealed beam lamp unit of the type referred to at the beginning of this specification, which in particular uses a quartz halogen filament lamp having two filaments for dipped beam and high beam light and can simply and cheaply be manufactured, the filament lamp support means having minimum mass, while adjustment of the filament lamp relative to the concave, in particular parabolic, reflector part can simply and, in the case of large-scale production, reproducibly be effected.

According to the invention this is achieved in an electric sealed beam unit of the specified type in that the filament lamp is provided with a sleeve-shaped bulb support member which is made of metal strip material and surrounds the lamp pinch of substantially rectangular cross-section and to which is secured a crank shaped supporting wire which is the sole lamp-supporting member. The term "cranked wire" is to be understood to mean a wire bent at least twice the oppositely directed ends of which extend substantially parallel to one another and preferably are co-planar.

The sleeve-shaped cap of metal strip folded in known manner (British patent specification No. 1,053,822) around the pinch substantially does not increase the mass of the lamp. The comparatively stiff supporting wire which serves as the single supporting member also has comparatively little mass and at the same time by its cranked shape enables the lamp to be simply aligned relative to the reflector part.

The sleeve-shaped cap preferably comprises two symmetrical cap halves.

In a preferred embodiment of the sealed beam lamp unit according to the invention there is secured to the sleeve-shaped cap a wire which extends parallel to the lamp axis to a point beyond the lamp and serves to carry a metal front light shield.

Preferably one of the current supply leads of the filament lamp is electrically connected to the sleeve-shaped cap, the support wire also acting as a lead.

The invention further relates to a method of manufacturing such as sealed beam lamp unit in which the filament lamp together with the support wire and possibly with further leads is mounted in the sleeve-shaped pinches of the reflector part and secured therein by soldering. According to the invention, before the insertion of the supporting wire in the fixed reflector part the filament lamp is aligned relative to said part by bending the cranked supporting wire.

During said alignment the filament lamp is preferably clamped in an adjustable device, the free end of the supporting wire being immovably held in front of the respective pinch of the reflector, after which the filament lamp is given the required position relative to the reflector part by bending the supporting wire and then the reflector part is axially slipped onto said wire.

Advantageously the cranked supporting wire is at least partly heated before the filament lamp is aligned. This heating is preferably effected by the passage of current.

Figure 2:
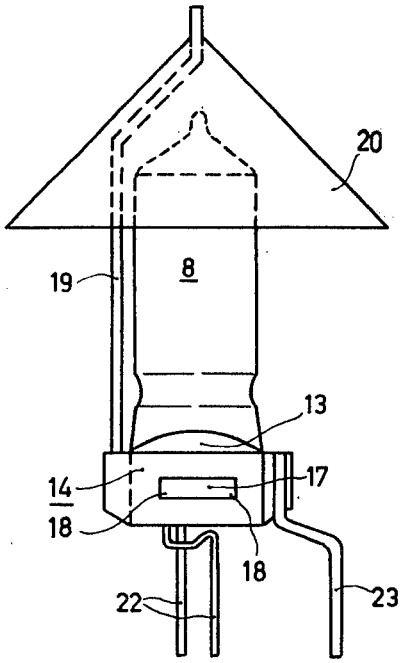
Figure 3:
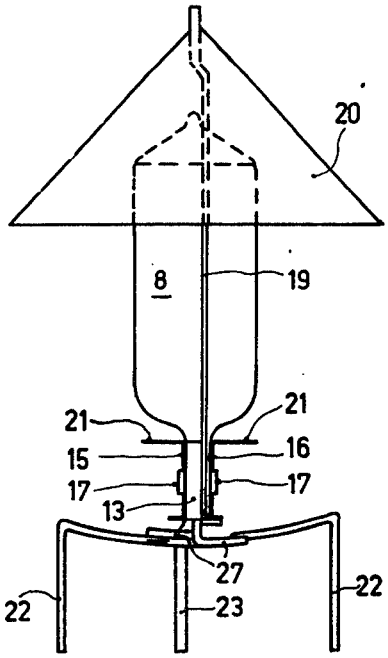
Figure 4:
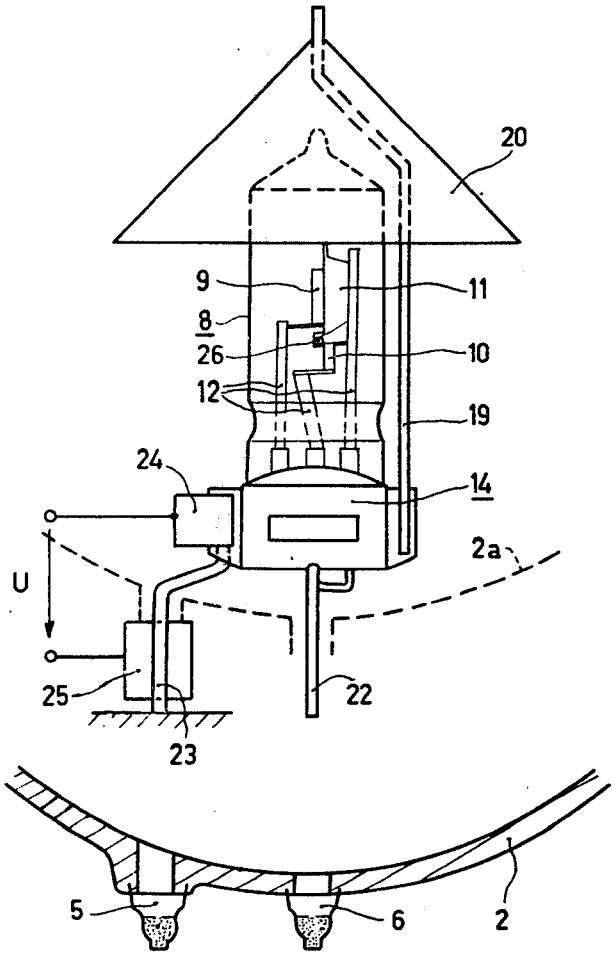

An embodiment of the invention will now be described; by way of example, with reference to the accompanying diagrammatic drawings, in which FIG. 1 shows, partly in section, a sealed beam lamp unit according to the invention in substantially actual size, FIG. 2 shows the quartz iodine filament lamp used in the unit shown in FIG. 1, FIG. 3 is a side elevation of the quartz iodine lamp of FIG. 2, and FIG. 4 illustrates the alignment of the quartz iodine filament lamp of FIGS. 2 and 3 relative to the reflector part of the sealed beam lamp unit of FIG. 1.

Referring now to FIG. 1, a sealed beam lamp unit has an outer envelope 1 which comprises a concave, in particular parabolic, glass reflector part 2 and a transparent front glass lens 3 sealed to the reflector part. The reflector part 2 is internally coated with a reflecting metal layer 4. The outer envelope 1 is filled with an inert gas; the pressure of the gas filling is 62 cm of mercury column at 20° C. The rear surface of the reflector part 2 is provided with three sleeve-shaped pinches, only two of which (5 and 6) are visible in FIG. 1. To the outer end of each of the pinches 5 and 6 a contact lug 7 is soldered.

The outer envelope 1 encloses a quartz iodine lamp 8 which has a dip filament 9 and a high beam filament 10 (FIG. 4). Reference numeral 11 denotes a cupshaped dipping shield and 12 denotes current supply leads in the lamp 8. The lamp 8 has a pinch 13 of substantially rectangular cross-section which is surrounded by a sleeve-shaped cap 14 made of thin metal sheet (FIGS. 2 and 3). The cap 14 comprises two half-caps 15 and 16 made of a resilient material, for example nickel-chromium steel, from 0.2 to 0.25 mm thick, which are joined to one another by spot welding and at their ends nearer the bulb have flanges 21 serving as a shield. To improve the attachment of the cap 14 to the pinch 13 the latter is formed with small projections 17 which extend in corresponding slots 18 in the half-caps 15 and 16.

Welded to the cap 14 is a holding wire 19 which extends parallel to the axis of the lamp 8 and beyond the latter and carries a cup-shaped metal shield 20 disposed in front of the lamp 8. The holding wire 19 preferably is located behind the cup-shaped dipping shield 11 for the dipping-beam filament 9 (FIG. 4).

There is further welded to the cap 14 an extension of one of the filament current supply leads 12, preferably the lead connected to the dipped-beam filament 9. Extensions 27 of the other two currents supply leads 12 project below the pinch-shaped cap 13 and are spot-welded to respective current supply leads 22 which are bent so as to fit in the sleeve-shaped pinches 6 of the reflector part 2. The current supply leads 22 are made of a manganese nickel alloy and each have a diameter of 0.75 mm.

In addition there is welded to the cap 14 a downwardly projecting cranked shaped supporting wire 23 which is made of titanium-stabilised iron and has a diameter of 1.8 mm. During assembly the wire 23 is secured in the sleeve-shaped pinch 5 of the reflector part 2 by soldering and is virtually the sole support for the lamp 8 in the outer envelope 1; it further acts as a current supply conductor for that current supply lead 12 of the dipped-beam filament 9 which is electrically connected to the cap 14.

The arrangement and alignment of the lamp 8 in the reflector part 2 will now be described with reference to FIG. 4. First the lamp shown in FIGS. 2 and 3 is clamped in a suitable device. In this device the cranked shaped supporting wire 23 is clamped between two tongs 24 and 25, the tong 25 being fixed and the tong 24 being movable. This ensures that the free end of the supporting wire 23 does not change position relative to the reflector pinch 5 of the reflector part 2, which is held in a suitable device beneath the lamp 8, during subsequent alignment of the lamp 8. For this alignment an electric voltage U is applied between the tongs 24 and 25 which causes a current to flow through the crank shaped part of the supporting wire 23 such that said part is heated and hence becomes deformable. Then the filaments 9 and 10 are rendered operative and the outlines of the filaments and the cup-shaped dipping shield are either projected greatly magnified onto a screen, so that the positions of the filaments and the shield are clearly visible, or the filament outlines are electronically scanned. By bending the heated supporting wire 23 by means of the tong 24 are geometry of the lamp 8 is moved into the desired tolerance region, i.e. the filament is so aligned relative to the reflector part 2 disposed beneath is that the focal point 26 of the reflector part 2 eventually lies between the filaments 9 and 10 on the longitudinal axis of the lamp 8. During alignment the free end of the supporting wire 23 is immovably held in front of its reflector pinch 5 by the tong 25, so that the geometry of the lamp is definitely aligned in a desired position relative to the single supporting wire 23. Subsequently the reflector part 2 together with the device holding it is moved into a position 2*a* beneath the lamp 8, which position is shown by broken lines. This movement is effected by axial displacement of the reflector part 2, the supporting wire 23 and the current conductors 22 slipping into the reflector pinches 5 in which they are then secured by brazing. Thus the lamp 8 is uniquely fixed with respect to the parabolic reflector part 2. Thus the operations of aligning the lamp 8 and securing it in the reflector part 2 are performed by means of a single supporting wire 23 the free end of which is so held during alignment as to ensure that it is immersed into the molten solder in the pinch 5.

Finally the front glass lens 3 is sealed to the reflector part 2, and the outer envelope 1 is filled with an inert gas.

What is claimed is:

1. A method of manufacturing a sealed beam lamp which comprises: providing an outer envelope including a reflector, providing a transparent front glass, providing a quartz halogen lamp disposed within said envelope, providing an elongated member for supporting the halogen lamp relative to the envelope, positioning said elongated member relative to said reflector, passing current through the elongated member sufficient to raise the temperature, thereof and facilitate permanent deformation; align deforming the elongated member to the said halogen lamp relative to said reflector thereafter moving said elongated member relative to said reflector to a second position for joining and then joining said reflector to said elongated member.

2. The method as described in claim 1 wherein said elongated member is crank-shaped.

3. The method as described in claim 2 wherein said reflector has a center line and said method includes the step after said deforming step of moving said reflector in a direction parallel to the center line thereof.

4. The method as described in claim 3 wherein said joining step includes soldering.

* * * * *